US005380046A

United States Patent [19]

Stephens

[11] Patent Number: 5,380,046

[45] Date of Patent: Jan. 10, 1995

[54] SECURED PERSONAL INFORMATION PACKET

[76] Inventor: Gregory W. Stephens, P.O. Box 472266, Charlotte, N.C. 28247

[21] Appl. No.: 114,138

[22] Filed: Aug. 30, 1993

[51] Int. Cl.[6] ..... B42D 15/10

[52] U.S. Cl. ..... 283/75; 283/70; 283/103; 283/107; 283/109; 283/904; 40/636; D19/10; D20/22; D20/27

[58] Field of Search ..... D19/3, 9, 10; 40/661, 40/636, 299; D20/22, 23, 25, 27–29; 283/70, 75, 80, 107, 61, 62, 904, 109, 901, 100, 103

[56] References Cited

U.S. PATENT DOCUMENTS

| | | | |
|---|---|---|---|
| D. 310,849 | 9/1990 | Davis | D20/22 |
| D. 331,265 | 11/1992 | Diblasio | D20/27 |
| 3,117,608 | 1/1964 | Goss et al. | 40/661 X |
| 3,792,542 | 2/1974 | Cohan | 283/76 |
| 4,254,556 | 3/1981 | Haskell | 40/636 |
| 4,536,975 | 8/1985 | Harrell | 40/636 X |
| 4,619,469 | 10/1986 | Grover | 283/76 |
| 4,815,768 | 3/1989 | Applebaum et al. | D19/10 X |
| 5,171,039 | 12/1992 | Dusek | 283/75 |
| 5,215,334 | 6/1993 | Presson et al. | 283/904 X |
| 5,269,564 | 12/1993 | Arnt | 283/100 X |

FOREIGN PATENT DOCUMENTS

| | | | |
|---|---|---|---|
| 2636160 | 3/1990 | France | 40/636 |

*Primary Examiner*—Mark Rosenbaum
*Assistant Examiner*—Frances Han
*Attorney, Agent, or Firm*—Shefte, Pinckney & Sawyer

[57] ABSTRACT

A personal information packet to be carried by a child or other person to provide identification and relevant information to authorities in the event of an emergency comprises a folded information card bearing personal information on the shielded inwardly folded side of the card sealed within a transparent plastic envelope to secure the card against outward view of the personal information and against unauthorized removal of the card without breaching the sealed integrity of the envelope. A notice is printed on the outward side of the card to alert authorities that personal information is contained within the packet and a broken line shows authorities where to cut open the packet without obliterating the information.

2 Claims, 1 Drawing Sheet

SECURED PERSONAL INFORMATION PACKET

BACKGROUND OF THE INVENTION

The present invention relates generally to personal information cards such as are typically carried on the person and, more particularly, to a personal information packet, preferably in the form of a flat card-like laminate, which may be carried on the person and which secures personal information written on a card or like information carrier enclosed within the packet against removal and unauthorized view without breaching the integrity of the enclosure, intended to occur only in the event of an emergency.

With the increases in metropolitan crime rates over recent years, including growth in the number of crimes against children, the handicapped, the elderly, and others who are less equipped to defend themselves, society has realized a heightened concern for personal safety and security, particularly when individuals are traveling alone.

It has been conventional practice for many years for individuals to carry on their persons some means of identification. While a state-issued drivers license suffices for a majority of adults, other means of identification are necessary for persons who cannot or do not operate automobiles, e.g., children, handicapped persons, and the elderly. Further, as to these groups of people, it is additionally important that other relevant information in addition to the person's identity be available to authorities in the case of an emergency, e.g., the name, address and telephone number of a guardian or close relative, important medical information, etc.

While it is important in the event of an emergency that such an information card be conspicuous enough on the person to be immediately located by authorities, it is conversely important for reasons of personal security that, at other times, the personal information be shielded from public view so that the information cannot be read and used for criminal purposes against the person. This problem is particularly acute in the case of children in that, because children typically are not accustomed to carrying a wallet or other personal items, it is common practice for parents to attach an information card or carrier to the child's clothing, e.g., an identification card interlaced in a child's shoestrings.

Thus, a particular need exists for providing children and other generally defenseless persons, such as the handicapped and the elderly, with a convenient means of carrying personal information to be readily accessible to authorities in emergency situations, but which securely shields the information from general public view at other times.

SUMMARY OF THE INVENTION

It is accordingly an object of the present invention to provide a novel personal information packet to be carried by a person so as to provide identification and relevant information concerning the person in an emergency, while otherwise securing the information against unauthorized access.

Briefly summarized, the personal information packet of the present invention in its most fundamental aspect basically comprises an information carrier bearing visually perceptible written information concerning the person and an enclosure containing the information carrier against outward view and securing the information carrier against removal without breaching the integrity of the enclosure.

In a preferred embodiment, the information packet comprises a card bearing the person's written information on only one side thereof, with the opposite side of the card bearing a visually perceptible notice that personal information is enclosed and bearing indicia instructing as to appropriate emergency opening of the packet. The card is folded upon itself to cover the written information from view without unfolding the card while leaving the notice and indicia outwardly perceptible. A transparent plastic envelope is laminated about the folded card to sealably enclose the card against outward view of the written information and to secure the card against removal without cutting open or otherwise breaching the sealed integrity of the envelope, with the notice and indicia being visible through the envelope.

Preferably, the envelope is formed with an opening for receiving a shoestring or other means for tying or similarly securing the packet to the body or clothing of the person, e.g., interlacing the packet in a child's shoestring.

DETAILED DESCRIPTION OF THE PREFERRED EMBODIMENT

Figure 3:
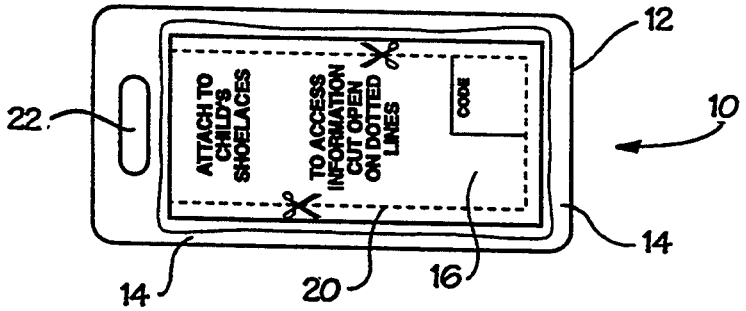
FIG. 3 is a front elevational view of the preferred embodiment of the present personal information packet, resulting from the assembly step shown in FIG. 2.

Referring now to the accompanying drawings and initially to FIG. 3, the personal information packet of the present invention is shown generally at 10 in its assembled form in accordance with the preferred embodiment of the present invention. The information packet 10 basically comprises a transparent plastic envelope 12 securely sealed at 14 continuously along the perimeter of the envelope 12 to securely enclose an information-bearing card 16 in sandwiched fashion between opposing outer plies of the envelope 12.

Figure 1:
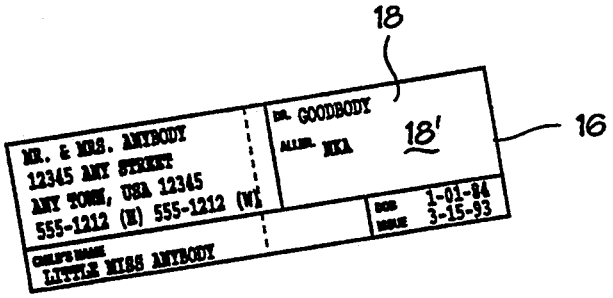
FIG. 1 is a front elevational view of an information card suitable for use in the preferred embodiment of the present personal information packet.
Figure 2:
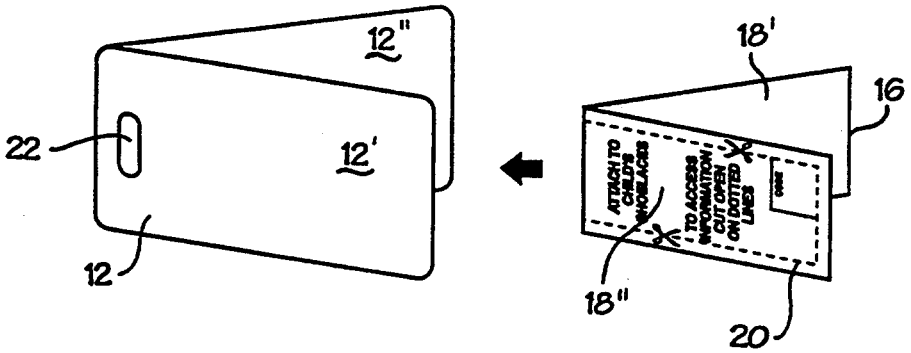
FIG. 2 is a perspective view illustrating the assembly of the information card of FIG. 1 with an enclosing plastic envelope, in accordance with the preferred embodiment of the present personal information packet.

As seen in FIG. 1, the information card 16 basically comprises a rectangular paper blank 18 preprinted on one side only as a form for convenient insertion of personal information, such as a bearer's name, address, telephone number, parent or guardian, etc., as indicated at 18'. The opposite face 18" of the paper blank 18 carries a notice such as "IMPORTANT INFORMATION ENCLOSED", or such other notice to a similar effect, as shown in FIG. 2, sufficient to alert others that personal information is carried on the other side 18' of the paper blank 18. The opposite face 18" of the paper blank 18 also has a broken line 20 printed along one or both lengthwise edges of the blank laterally outside the information field on the side 18', to act as a cutting guide for emergency opening of the packet 10 as more fully explained hereinafter. The paper blank 18 is foldable midway along its length, whereby the personal information contained on the first side 18' is completely covered from outward view, leaving only the notice and the broken line 20 on the opposite face 18" outwardly visible and readable.

As shown in FIG. 2, the plastic envelope 12 comprises dual rectangular plies 12',12" of a transparent thermoplastic material secured to one another along one corresponding edge either by folding together a single layer of rectangular plastic sheeting or preliminarily sealing the two plastic plies 12',12" together. As so configured, the two plies 12',12" of the envelope 12 are unattached along the remaining three sides, enabling the folded card 16 to be easily inserted between the two plies 12',12", after which the plies 12',12" are sealably joined to one another, e.g., by a laminating process, over the entire perimeter of the envelope 12 laterally outward of the interior space occupied by the folded card 16, thereby to sealably and securely enclose the card 16 within the envelope 12 resulting in the finished packet 10 of FIG. 3. Preferably, aligned openings 22 are preformed through the two plies 12',12" of the envelope 12 adjacent their joining edge to provide a single opening in the finished packet 10 by which the packet can be laced into a child's shoestring or, alternatively, carried on a neck chain, bracelet, knapsack or bookbag, etc.

Figure 4:
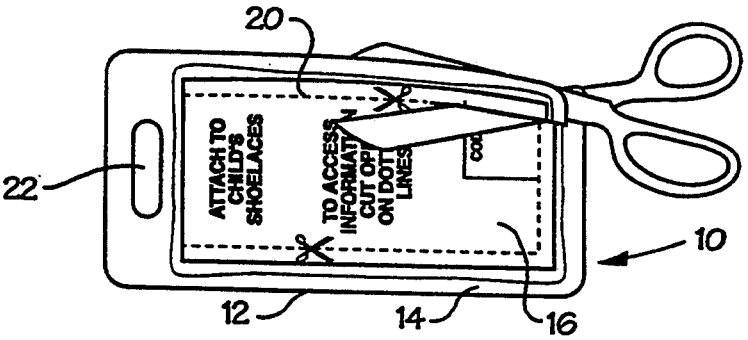
FIG. 4 is another elevational view, similar to FIG. 3, of the present personal information packet, showing the intended means of opening the packet to obtain access to the enclosed information card in the event of an emergency.

As will thus be understood, the finished packet 10 provides a convenient means for a child, handicapped person, or elderly person to carry on their person relevant personal information which could be important in the event of an emergency, while securing the information against unauthorized access otherwise. The notice appearing on the outward face of the information card 16 will be readily visible through the transparent envelope 12 to alert authorities to the availability of the personal information within the packet in the case of an emergency, with the broken lines 20 showing authorities the appropriate cutting line or lines along which to open the packet, e.g., by the use of scissors as shown in FIG. 4, to obtain access to the information.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A personal information packet to be carried by a person to provide identification and relevant information concerning the person in an emergency, the packet comprising a card bearing visually perceptible written information concerning the person on only one side thereof and bearing on the opposite side thereof a visually perceptible notice that personal information is enclosed and indicia for emergency opening of the packet, the card being folded upon itself along a transverse fold line into two parallel face abutting planar plies of equal size with the opposite side of the card facing outwardly from each ply to cover the written information from view without unfolding the card while leaving the notice and emergency opening indicia outwardly perceptible, and a transparent plastic envelope having two plastic leaves laminated about the folded card to adhere each plastic leaf to a respective ply of the card to sealably enclose the card against outward view of the written information and to secure the card against removal without breaking the sealed integrity of the envelope, with the notice and emergency opening indicia being visible through the envelope, the emergency opening indicia comprising a generally continuous guide line extending from adjacent one end of the fold line along the perimeter of one ply of the folded card to adjacent the other end of the fold line to serve as a guide line for cutting open the laminated envelope without destroying the concealed information on the opposite side of the folded card.

2. A personal information packet according to claim 1 wherein the envelope is formed with an opening for receiving a tying strand by which the packet may be secured to the body or clothing of the person.

* * * * *